US011462839B2

(12) United States Patent
Li et al.

(10) Patent No.: US 11,462,839 B2
(45) Date of Patent: Oct. 4, 2022

(54) PHASE ANTENNA ASSEMBLY AND ELECTRONIC DEVICE

(71) Applicant: SHENZHEN JAGUAR WAVE TECHNOLOGY LTD., Shenzhen (CN)

(72) Inventors: Wei-Tsung Li, Shenzhen (CN); Chihkai Liu, Shenzhen (CN); Peizong Rao, Shenzhen (CN)

(73) Assignee: SHENZHEN JAGUAR WAVE TECHNOLOGY LTD., Shenzhen (CN)

( * ) Notice: Subject to any disclaimer, the term of this patent is extended or adjusted under 35 U.S.C. 154(b) by 159 days.

(21) Appl. No.: 17/026,337

(22) Filed: Sep. 21, 2020

(65) Prior Publication Data

US 2022/0059944 A1 Feb. 24, 2022

(30) Foreign Application Priority Data

Aug. 18, 2020 (CN) ..... 202010832875.3

(51) Int. Cl.
*H01Q 21/24* (2006.01)
*H01Q 21/06* (2006.01)
*H01Q 23/00* (2006.01)

(52) U.S. Cl.
CPC ..... *H01Q 21/245* (2013.01); *H01Q 21/061* (2013.01); *H01Q 23/00* (2013.01)

(58) Field of Classification Search
CPC .. H01Q 1/243; H01Q 1/2266; H01Q 21/0025; H01Q 21/061; H01Q 21/062; H01Q 21/064; H01Q 21/065; H01Q 21/24; H01Q 21/245; H01Q 23/00; H01L 23/66; H01L 2223/6677
See application file for complete search history.

(56) References Cited

U.S. PATENT DOCUMENTS

2022/0085502 A1* 3/2022 Arai ..... H01Q 21/065

* cited by examiner

*Primary Examiner* — Robert Karacsony

(57) ABSTRACT

The present disclosure discloses a phase antenna assembly and an electronic device using the phase antenna assembly. The phase antenna assembly includes a first antenna baseboard, a second antenna baseboard, and a connection baseboard: the first antenna baseboard includes a first polarization antenna array and a first connection node array; the second antenna baseboard includes a second polarization antenna array and a second connection node array; the connection baseboard includes a third connection node array and a fourth connection node array; the third connection node array is connectable with the first connection node array by at least two connection manners with different angles, and/or the fourth connection node array is connectable with the second connection node array by at least two connection manners with different angles.

13 Claims, 6 Drawing Sheets

PHASE ANTENNA ASSEMBLY AND ELECTRONIC DEVICE

TECHNICAL HELD

The present disclosure relates to the field of communication technologies, and in particular, to a phase antenna assembly and an electronic device.

BACKGROUND

With rapid development of science and technology, wireless communication technology has become the most widely used technology in social life, and plays an indispensable role in society, especially in the field of mobile communication. Antennas, as devices used to radiate and receive radio waves in radio apparatuses, play a vital role in the field of wireless communication.

Polarization directions of existing antennas are often determined at the beginning of design, and lack flexibility. However, the degree of matching between antennas for transmitting or exchanging electrical signals will determine the polarization loss, thereby affecting transmission efficiency of radio signals.

SUMMARY

The present disclosure provides a phase antenna assembly and an electronic device, so as to solve the problem that an existing antenna assembly is unable to change a polarization direction.

In order to solve the above technical problem, one technical solution adopted by the present disclosure is to provide a phase antenna assembly, the phase antenna assembly comprises a first antenna baseboard, a second antenna baseboard, and a connection baseboard; the first antenna baseboard includes a first polarization antenna array and a first connection node array; the second antenna baseboard includes a second polarization antenna array and a second connection node array; the connection baseboard includes a third connection node array and a fourth connection node array; wherein, the third connection node array is configured to be connected with the first connection node array, the fourth connection node array is configured to be connected with the second connection node array, the third connection node array is electrically connectable with the first connection node array by at least two connection manners with different angles, and/or the fourth connection node array is electrically connectable with the second connection node array by at least two connection manners with different angles.

In order to solve the above technical problem, another technical solution adopted by the present disclosure is to provide an electronic device, the electronic device comprises the aforesaid phase antenna assembly and a device body, the phase antenna assembly is disposed on the device body.

In order to solve the above technical problem, another technical solution adopted by the present disclosure is to provide a phase antenna assembly, the phase antenna assembly comprises: a first antenna baseboard including a first polarization antenna array and a plurality of first chip groups electrically connected with the first polarization antenna array, wherein, each first chip group includes a plurality of first chips electrically connected through traces, and a first connection node array is formed by nodes on the traces electrically connecting the first chips; a second antenna baseboard including a second polarization antenna array and a plurality of second chip groups electrically connected with the first polarization antenna array, wherein, each second chip group includes a plurality of second chips electrically connected through traces, and a second connection node array is formed by nodes on the traces electrically connecting the second chips; and a connection baseboard including a third connection node array and a fourth connection node array; wherein, the third connection node array is electrically connectable with the first connection node array by at least two connection manners, the fourth connection node array is electrically connectable with the second connection node array by at least two connection manners.

Advantageous effect of the present disclosure is that: differing from the prior art, in the present disclosure, by the arrangement in which at least two kinds of connections by different angles can be implemented between the third connection node array and the first connection node array, and/or at least two kinds of connections by different angles can be implemented between the fourth connection node array and the second connection node array, it is further possible to change respective connecting angles of the first antenna baseboard and the second antenna baseboard relative to the connection baseboard, so as to achieve antenna assemblies in different polarization manners. In this way, it is possible to change the polarization manner using different angles by means of post assembly, and it is not required to determine or stabilize the polarization manner during a designing or manufacturing process. Moreover, by performing connections by different angles for the first antenna baseboard, the second antenna baseboard, and the connection baseboard, many kinds of combined polarization manners of an antenna can be implemented, and effective isotropic radiated power (EIRP) of the antenna assembly is further improved.

BRIEF DESCRIPTION OF THE DRAWINGS

In order to describe technical solutions of embodiments of the present disclosure or of the prior art more clearly, drawings required being used in description of the embodiments or of the prior art will be simply introduced below. Obviously, the drawings in the following description are merely some embodiments of the present disclosure. For one of ordinary skill in the art, it is also possible to obtain other drawings according to these drawings without paying any creative work. Wherein.

DETAILED DESCRIPTION

Technical solutions of embodiments of the present disclosure will be clearly and completely described below with reference to the drawings in the embodiments of the present disclosure. Obviously, the described embodiments are merely some embodiments, but not all embodiments of the present disclosure, Based on the embodiments of the present disclosure, all of the other embodiments obtained by one of ordinary skill in the art without making any creative work belong to the protection scope of the present disclosure.

Terms "first", "second", "third", and the like in embodiments of the present disclosure are merely used for the purpose of description, and should not be considered as indicating or implying relative importance or implicitly specifying the number of indicated technical features. Accordingly, a feature defined by "first", "second", "third", or the like can explicitly or implicitly include at least one such feature. In the description of the present disclosure, "a plurality of" means at least two, such as two, three, etc., unless otherwise clearly and specifically defined. Furthermore, the terms "including" and "having", and any variations thereof are intended to cover non-exclusive inclusion. For example, a process, method, system, product, or device containing a series of steps or units is not limited to the listed steps or units, but optionally also includes steps or units not listed, or optionally further includes other steps or units inherent to the process, method, product, or device.

Reference to "an embodiment" herein means that particular features, structures, or characteristics described in connection with embodiments may be included in at least one embodiment of the disclosure. Appearances of this phrase in various places in the specification are not necessarily all referring to the same embodiment, nor are they independent or alternative embodiments that are mutually exclusive with other embodiments. It is explicitly and implicitly understood by those skilled in the art that the embodiments described herein may be combined with other embodiments.

The present disclosure is intended to solve the problem that polarization directions of existing antennas are often determined at the beginning of design and lack flexibility, and it is also unable to change the polarization directions later, requirements of different scenes cannot be met, and it may be caused that transmission efficiency of radio signals in some improper scenes is low.

Figure 1:
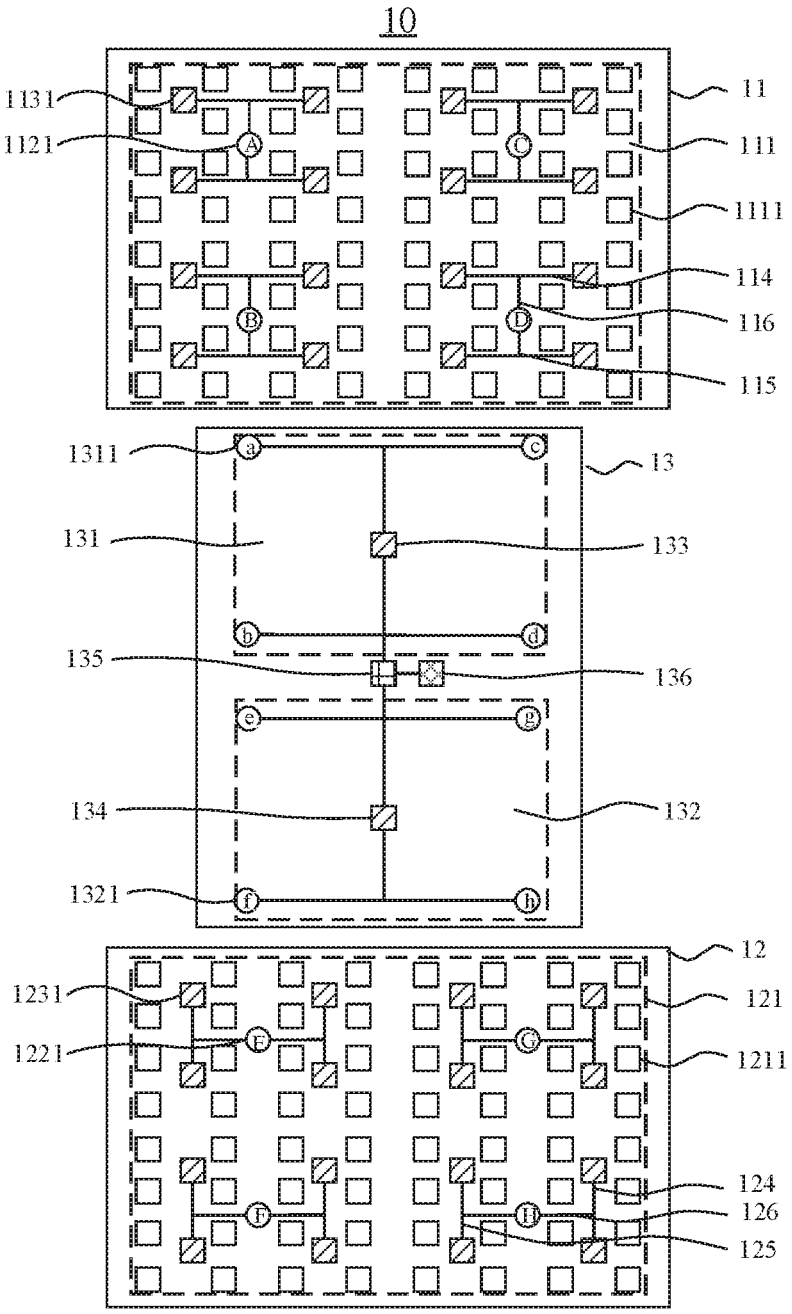
FIG. 1 is a structural schematic view of an embodiment of a phase antenna assembly of the present disclosure.

Referring to FIG. 1, FIG. 1 is a structural schematic view of an embodiment of a phase antenna assembly of the present disclosure.

Figure 2:
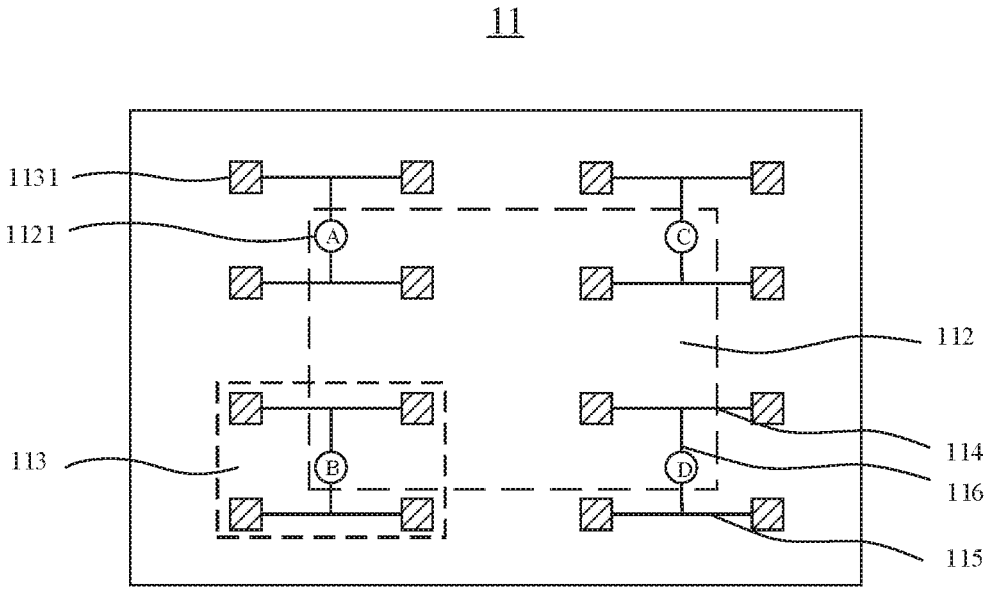
FIG. 2 is a structural schematic view of a first chip group and a first connection node array of an embodiment of a phase antenna assembly of the present disclosure.

Referring to FIG. 2, FIG. 2 is a structural schematic view of a first chip group and a first connection node array of an embodiment of a phase antenna assembly of the present disclosure.

Figure 3:
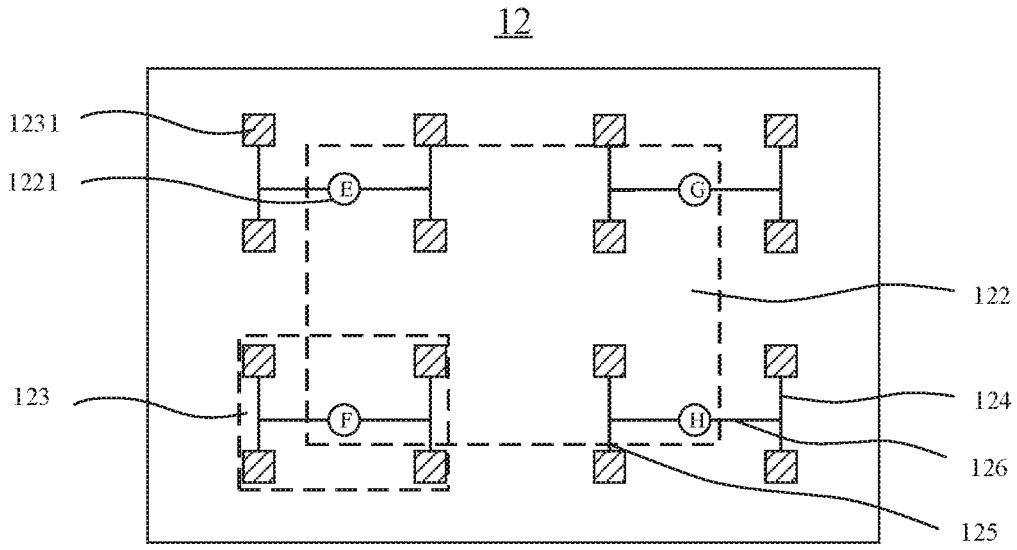
FIG. 3 is a structural schematic view of a second chip group and a second connection node array of an embodiment of a phase antenna assembly of the present disclosure.

Referring to FIG. 3, FIG. 3 is a structural schematic view of a second chip group and a second connection node array of an embodiment of a phase antenna assembly of the present disclosure.

A phase antenna assembly 10 can comprise a first antenna baseboard 11, a second antenna baseboard 12, and a connection baseboard 13. The first antenna baseboard 11 can be connected with the connection baseboard 13. The second antenna baseboard 12 can be connected with the connection baseboard 13. A connecting angle for the first antenna baseboard 11 and the connection baseboard 13 relates to a polarization direction of the first antenna baseboard 11. A connecting angle for the second antenna baseboard 12 and the connection baseboard 13 relates to a polarization direction of the second antenna baseboard 12.

As shown in FIG. 1 and FIG. 2, the first antenna baseboard 11 can includes a first polarization antenna array 111, a first connection node array 112, and a plurality of first chip groups 113 arranged in a matrix. The first chip group 113 is electrically connected with the first polarization antenna array 111, so as to convert electric signals into electromagnetic waves to be transmitted through the first polarization antenna array 111, and convert electromagnet waves received by the polarization antenna array 111 into electric signals to be transferred. The first polarization antenna array 111 can include a plurality of first array elements 1111 arranged in an array. The first connection node array 112 can include a plurality of first connection nodes 1121 arranged in an array. The first chip group 113 can include a plurality of first chips 1131 arranged in an array. The first chips 1131 are electrically connected through traces, and the first connection node array 112 is formed by nodes on these traces. Obviously, the first connection node array 112 is also electrically connected with the first polarization antenna array 111 through the first chip group 113.

Optionally, some first chips 1131 of the first chip group 113 are electrically connected via a first trace 114, and other first chips 1131 of the first chip group 113 are electrically connected via a second trace 115. Respective middle points of the second trace 115 and of the first trace 114 are electrically connected via a first common trace 116, a middle of the first common trace 116 is provided with a first connection node 1121, and the first connection nodes 1121 corresponding to the plurality of first chip groups 113 are arranged in an array to form the first connection node array 112.

For example, the first antenna baseboard 11 can include four first chip groups 113 arranged in a matrix. Each first chip group 113 consists of, for example, four first chips 1131. Four first array elements 1111 are distributed evenly or unevenly around each first chip 1131. Two first chips 1131 of the first chip group 113 are electrically connected via a first trace 114. The other two first chips 1131 of the first chip group 113 are electrically connected via a second trace 115. Respective middle points of the first trace 114 and of the second trace 115 are electrically connected via a first common trace 116, a middle of the first common trace 116 is provided with a first connection node 1121. The first connection nodes 1121 disposed at respective middles of the four first common traces 116 form the first connection node array 112. As shown in FIG. 1 and FIG. 2, the first connection nodes 1121 are specifically four connection nodes A, B, C, D.

The first array element 1111 is an antenna radiation unit, and a plurality of first array elements 1111 are arranged according to a certain law to form the first polarization antenna array 111. The first array element 1111 can transmit or receive electromagnetic waves, the first chip 1131 can convert electric signals into electromagnetic waves to be transmitted through the first array elements 1111, and can also convert electromagnet waves received by the first array elements 1111 into electric signals to be transferred. Further, the first antenna baseboard 11 in the present disclosure can achieve conversion between electric signals and electromagnetic waves through the first polarization antenna array 111 and the first chip group 113.

For example, the first chip group 113 can be a chip group of which the number of chips is 2*2, and the first chips 1131 are mutually connected through three traces, such a structure can lower producing and repairing cost to a very large extent. Of course, the first chip group 113 can also adopt other chip structures, such as 4*4 chips, 8*8 chips, and so on, as long as transmission and conversion for signals can be performed and connection nodes can be distributed.

As shown in FIG. 1 and FIG. 3, the second antenna baseboard 12 can includes a second polarization antenna array 121, a second connection node array 122, and a plurality of second chip groups 123 arranged in a matrix. The second chip group 123 is electrically connected with the first polarization antenna array 121, so as to convert electric signals into electromagnetic waves to be transmitted through the first polarization antenna array 121, and convert electromagnet waves received by the polarization antenna array 121 into electric signals to be transferred. The second polarization antenna array 121 includes a plurality of second array elements 1211 arranged in an array. The second connection node array 122 includes a plurality of second connection nodes 1221 arranged in an array. The second chip group 123 can include a plurality of second chips 1231 arranged in an array. The second chips 1231 are electrically connected through traces, and the second connection node array 122 is formed by nodes on these traces. Obviously, the second connection node array 122 is also electrically connected with the second polarization antenna array 121 through the second chip group 123.

Optionally, the second antenna baseboard 12 includes a plurality of second chip groups 123 arranged in a matrix, some second chips 1231 of the second chip group 123 are electrically connected via a third trace 124 and other second chips 1231 of the second chip group 123 are electrically connected via a fourth trace 125. Respective middle points of the third trace 124 and of the fourth trace 125 are electrically connected via a second common trace 126, a middle of the second common trace 126 is provided with a second connection node 1221, and the second connection nodes 1221 corresponding to the plurality of second chip groups 123 are arranged in an array to form the second connection node array 112.

For example, the second antenna baseboard 12 can include four second chip groups 123 arranged in a matrix. Each second chip group 123 consists of, for example, four second chips 1231. Four second array elements 1211 are distributed evenly or unevenly around each second chip 1231. Two second chips 1231 of the second chip group 123 are electrically connected via a third trace 124. The other two second chips 1231 of the second chip group 123 are electrically connected via a fourth trace 125. Respective middle points of the third trace 124 and of the fourth trace 125 are electrically connected via a second common trace 126. A middle of the second common trace 126 is provided with a second connection node 1221. The second connection nodes 1221 disposed at respective middles of the four second common traces 126 form the second connection node array 122. As shown in FIG. 1 and FIG. 3, the second connection nodes 1221 are specifically four connection nodes E, F, G, H.

The second array element 1211 is an antenna radiation unit, and a plurality of second array elements 1211 are arranged according to a certain law to form the second polarization antenna array 121. The second array element 1211 can transmit or receive electromagnetic waves, the second chip 1231 can convert electric signals into electromagnetic waves to be transmitted through the second array elements 1211, and can also convert electromagnet waves received by the second array elements 1211 into electric signals to be transferred. Further, the second antenna baseboard 12 in the present disclosure can achieve conversion between electric signals and electromagnetic waves through the second polarization antenna array 121 and the second chip group 123.

For example, the second chip group 123 can be a chip group of which the number of chips is 2*2, and the second chips 1231 are mutually connected through three traces, such a structure can lower producing and repairing cost to a very large extent. Of course, the second chip group 123 can also adopt other chip structures, such as 4*4 chips, 8*8 chips, and so on, as long as transmission and conversion for signals can be performed and connection nodes can be distributed.

As shown in FIG. 1, the connection baseboard 13 can include a third connection node array 131, a fourth connection node array 132, a third chip 133, a fourth chip 134, a transceiver 135, and a phase locked loop 136. The third chip 133, the fourth chip 134, and the phase locked loop 136 are electrically connected to the transceiver 135 respectively.

As shown in FIG. 1, the transceiver 135 can be located between the third chip 133 and the fourth chip 134, and the transceiver 135 is electrically connected with the third chip 133 and the fourth chip 134 respectively.

It is worth noting that the third chip 133 and the fourth chip 134 are not necessary requirements for the present disclosure. When the present disclosure is provided with the third chip 133 and the fourth chip 134, since both the third chip and the fourth chip are provided thereon with power dividers, distribution and synthesis for signal energy can be realized, and signal energy corresponding to the first antenna baseboard 11, the second antenna baseboard 12, or more antenna baseboards can be adjusted. Therefore, the present disclosure can solve the conventional technical problem that when transceivers and multi-channel phase arrays are integrated in the same baseboard, a multi-channel power divider is required, which will increase design difficulty and heighten additional interstage loss. Thus, the technical effect of lowering complexity of the power divider and minimizing interstage loss as much as possible is achieved.

Optionally, the third connection node array 131 is configured to be connected with the first connection node array 112. The third connection node array 131 includes a plurality of third connection nodes 1311 arranged in an array. In this embodiment, the plurality of third connection nodes 1311 can specifically be four connection nodes a, b, c, d. The fourth connection node array 132 is configured to be connected with the second connection node array 122. The fourth connection node array 132 includes a plurality of fourth connection node 1321 arranged in an array. In this embodiment, the plurality of fourth connection nodes 1321 can specifically be four connection nodes e, f, g, h. At least two kinds of connections by different angles can be implemented between the third connection node array 131 and the first connection node array 112, and/or at least two kinds of connections by different angles can be implemented between the fourth connection node array 132 and the second connection node array 122.

Optionally, the third chip 133 is electrically connected with the third connection node 1311. The fourth chip 134 is electrically connected with the fourth connection node 1321.

As shown in FIG. 1, the third chip 133 can be located at a center of the third connection node array 131 and be electrically connected with each third connection node 1311. The fourth chip 134 can be located at a center of the fourth connection node array 132 and be electrically connected with each fourth connection node 1321.

In this embodiment, by changing an angle of connection between the third connection node array 131 and the first connection node array 112, and/or an angle of connection between the fourth connection node array 132 and the second connection node array 122, a polarization direction of the antenna assembly can be changed. For example, the connection base 13 can be relatively fixed, that is, positions of the third connection node array 131 and of the fourth connection node array 132 are respectively fixed. When respective corresponding relations of the first connection node array 112 and the third connection node array 131 with the connection baseboard 13 generate changes, that is, a direction of the first antenna baseboard 11 relative to the connection baseboard 13 generates a change, a direction of an electric field intensity formed by radiation of the first polarization antenna array 111 generates a change, such that a polarization direction of the first antenna baseboard 11 generates a change. When a corresponding relation between the second connection node array 122 and the fourth connection node array 132 generate a change, that is, a direction of the second antenna baseboard 12 relative to the connection baseboard 13 generates a change, a direction of an electric field intensity formed by radiation of the second polarization antenna array 121 generates a change, such that a polarization direction of the second antenna baseboard 12 generates a change. In specific operations, according to desired polarization directions, corresponding connection angles is determined. Specifically, the first antenna baseboard 11 and the second antenna baseboard 12 can be rotated, and thus respective relative angles of the first antenna baseboard 11 and the second antenna baseboard 12 relative to the connection baseboard 13 can be changed; the first antenna baseboard 11 and the second antenna baseboard 12 are then respectively assembled with the connection baseboard 13, desired polarization directions can be achieved, and it is not required to determine a polarization direction during designing and manufacturing processes.

As shown in FIG. 1, FIG. 2, and FIG. 3, if the first connection node array 112 and the third connection node array 131 connected in a manner of A to a, B to b, C to c, D to d are defined as a connection with one angle, a polarization direction of the current first antenna baseboard 11 is defined as vertical polarization. When the first connection node array 112 and the third connection node array 131 are connected in a manner of A to b, B to d, C to a, D to c, it can be a connection with another angle differing from the above angle; at this time, the polarization direction of the first antenna baseboard 11 changes into horizontal polarization. Similarly, at least two kinds of connections by different angles can be implemented between the third connection node array 131 and the first connection node array 112; with difference of the connection angle, the polarization direction of the first antenna baseboard 11 generates a change correspondingly.

As shown in FIG. 1, FIG. 2, and FIG. 3, if the second connection node array 122 and the fourth connection node array 132 connected in a manner of E to e, F to f, G to g, H to h are defined as a connection with one angle, a polarization direction of the current second antenna baseboard 12 is defined as vertical polarization. When the second connection node array 122 and the fourth connection node array 131 are connected in a manner of E to f, F to h, G to e, H to g, it can be a connection with another angle differing from the above angle; at this time, the polarization direction of the second antenna baseboard 12 changes into horizontal polarization. Similarly, at least two kinds of connections by different angles can be implemented between the fourth connection node array 132 and the second connection node array 122; with difference of the connection angle, the polarization direction of the second antenna baseboard 12 generates a change correspondingly. Therefore, the present disclosure can achieve different combined polarization manners by changing the connection angle(s) between the third connection node array 131 and the first connection node array 112 and/or between the fourth connection node array 132 and the second connection node array 122.

Therefore, the present disclosure can change a polarization manner with different angles by means of post assembly, and does not require determining or stabilizing the polarization manner during a designing or manufacturing process. Moreover, by performing connections by different angles for the first antenna baseboard 11, the second antenna baseboard 12, and the connection baseboard 13, many kinds of combined polarization manners of an antenna can be implemented, and effective isotropic radiated power (EIRP) of the antenna assembly is further improved.

Optionally, the third connection node array 131 is connected with the first connection node array 112 through metal fasteners or wires, and/or the fourth connection node array 132 is connected with the second connection node array 122 through metal fasteners or wires.

The third connection node array 131 can be connected with the first connection node array 112 by any method having the function of relative fixing and electrical connection, which includes assembly methods using fasteners, such as metal fasteners, wires, or bolts and nuts, such that the first antenna baseboard 11 and the connection baseboard 13 are mutually fixed and can perform signal transmission. The fourth connection node array 132 can be connected with the second connection node array 122 by any method having the function of relative fixing and electrical connection, which includes assembly methods using fasteners, such as metal fasteners, wires, or bolts and nuts, such that the second antenna baseboard 12 and the connection baseboard 13 are mutually fixed and can perform signal transmission. Therefore, the present disclosure can enable a plurality of monopolarized antennas to realize combination by the method of assembly with fasteners. Moreover, by means of metal fasteners or wires, it is possible to enable the first antenna baseboard 11, the second antenna baseboard 12, and the connection baseboard 13 to adjust connecting angles according to actual conditions, the flexibility is better.

Optionally, the number of the third connection nodes 1311 is equal to the number of the first connection nodes 1121, and the third connection nodes 1311 are in one-to-one correspondence with the first connection nodes 1121. The number of the fourth connection nodes 1321 is equal to the number of the second connection nodes 1221, and the fourth connection nodes 1321 are in one-to-one correspondence with the second connection nodes 1221.

By the one-to-one corresponding connection between the first connection nodes 1121 and the third connection nodes 1311, electrical connections with multiple angles can be realized between the first antenna baseboard 11 and the antenna third baseboard 13. Under different corresponding angles, the first connection nodes 1121 and the third connection nodes 1311 still maintain the one-to-one correspondence and can achieve connection. Similarly, by the one-to-one corresponding connection between the second connection nodes 1221 and the fourth connection nodes 1321, electrical connections with multiple angles can be realized between the second antenna baseboard 12 and the antenna third baseboard 13. Under different corresponding angles, the second connection nodes 1221 and the fourth connection nodes 1321 still maintain the one-to-one correspondence and can achieve connection. When electrical connections with multiple angles are simultaneously realized between the first connection nodes 1121 and the third connection nodes 1311 and between the second connection nodes 1221 and the fourth connection nodes 1321, electrical connections with multiple angles can be realized between the first antenna baseboard 11 and the second antenna baseboard 12.

Optionally, the third connection node array 131 and the first connection node array 112 are rotationally symmetric, and/or the fourth connection node array 132 and the second connection node array 122 are rotationally symmetric. In this embodiment, "rotationally symmetric" can mean that the third connection node array 131 and the first connection node array 112 may be centrosymmetric about a certain point, and/or the fourth connection node array 132 and the second connection node array 122 may be centrosymmetric about a certain point.

In this embodiment, there can be a symmetry center between the third connection node array 131 and the first connection node array 112, when the third connection node array 131 rotates by a certain angle around the symmetric center, it can coincide with the first connection node array 112; and/or there can be a symmetry center between the fourth connection node array 132 and the second connection node array 122, when the fourth connection node array 132 rotates by a certain angle around the symmetric center, it can coincide with the second connection node array 122. By this method, it can be achieved that the first antenna baseboard 11 can still be electrically connected with the connection baseboard 13 after rotating by a certain angle and/or that the second antenna baseboard 12 can still be electrically connected with the connection baseboard 13 after rotating by a certain angle.

Optionally, the third connection node array 131 and the first connection node array 112 are rotationally symmetric by 90 degrees, and/or the fourth connection node array 132 and the second connection node array 122 are rotationally symmetric by 90 degrees. In this embodiment, "rotationally symmetric by 90 degrees" can mean that one of the third connection node array 131 and the first connection node array 112 may coincide with the other after being rotated by 90 degrees around a certain point, and/or one of the fourth connection node array 132 and the second connection node array 122 may coincide with the other after being rotated by 90 degrees around a certain point.

The first connection node array 112, the second connection node array 122, the third connection node array 131, or the fourth connection node array 132 are all, for example, square arrays.

As shown in FIG. 1, FIG. 2, and FIG. 3, there is a symmetry center between the third connection node array 131 and the first connection node array 112, when the third connection node array 131 rotates by 90 degrees around the symmetric center, it can coincide with the first connection node array 112; and/or there is a symmetry center between the fourth connection node array 132 and the second connection node array 122, when the fourth connection node array 132 rotates by 90 degrees around the symmetric center, it can coincide with the second connection node array 122. By this method, it can be achieved that the first antenna baseboard 11 can still be electrically connected with the connection baseboard 13 after rotating by 90 degrees and/or that the second antenna baseboard 12 can still be electrically connected with the connection baseboard 13 after rotating by 90 degrees. In this way, between the first and third connection node arrays 112 and 131, a connection manner at a first angle and a connection manner at a second angle are switchable into each other by rotating the first antenna baseboard 11 by 90 degrees relative to the connection baseboard 13; and between the second and fourth connection node arrays 122 and 132, a connection manner at a first angle and a connection manner at a second angle are switchable into each other by rotating the second antenna baseboard 12 by 90 degrees relative to the connection baseboard 13.

Optionally, a plane where the third connection node array 131 is located is parallel to a plane where the first connection node array 112 is located. An arranging direction of node arrays in the plane where the third connection node array 131 is located is defined as 0 degree, a first angle is 0 degree, 180 degrees, or 360 degrees, and a second angle is 90 degrees or 270 degrees.

Specifically, a plane where the third connection node array 131 is located is parallel to a plane where the first connection node array 112 is located, and thus mutual connection of the first antenna baseboard 11 and the connection baseboard 13 on the same horizontal plane can be realized. When the first antenna baseboard 11 is horizontally rotated by 90 degrees relative to the arranging direction of node arrays in the plane where the third connection node array 131 is located, its polarization direction generates a change.

For example, when the first connection node array 112 is at a first angle, that is, 0 degree, 180 degrees, or 360 degrees, relative to the arranging direction of node arrays in the plane where the third connection node array 131 is located, the polarization direction of the first antenna baseboard 11 is its original polarization direction, that is, vertical polarization. When the first connection node array 112 is at a second angle, that is, 90 degrees or 270 degrees, relative to the arranging direction of node arrays in the plane where the third connection node array 131 is located, the polarization direction of the first antenna baseboard 11 generates a change, that is, changes into horizontal polarization.

Optionally, a plane where the fourth connection node array 132 is located is parallel to a plane where the second connection node array 122 is located. An arranging direction of node arrays in the plane where the fourth connection node array 132 is located is defined as 0 degree, a first angle is 0 degree, 180 degrees, or 360 degrees, and a second angle is 90 degrees or 270 degrees.

Specifically, a plane where the fourth connection node array 132 is located is parallel to a plane where the second connection node array 122 is located, and thus mutual connection of the second antenna baseboard 12 and the connection baseboard 13 on the same horizontal plane can be realized. When the second antenna baseboard 12 is horizontally rotated by 90 degrees relative to the arranging direction of node arrays in the plane where the fourth connection node array 132 is located, its polarization direction generates a change.

For example, when the second connection node array 122 is at a first angle, that is, 0 degree, 180 degrees, or 360 degrees, relative to the arranging direction of node arrays in the plane where the fourth connection node array 132 is located, the polarization direction of the second antenna baseboard 12 is its original polarization direction, that is, vertical polarization. When the the second connection node array 122 is at a second angle, that is, 90 degrees or 270 degrees, relative to the arranging direction of node arrays in the plane where the fourth connection node array 132 is located, the polarization direction of the second antenna baseboard 12 generates a change, that is, changes into horizontal polarization.

Therefore, by implementing connection at the first angle or the second angle between the third connection node array 131 and the first connection node array 112 and/or connection at the first angle or the second angle between fourth connection node array 132 and the second connection node array 122, the phase antenna assembly 10 in different polarization manners, such as a polarization manner for two groups of horizontally polarized antennas, a polarization manner for two groups of vertically polarized antennas, or a polarization manner for a dual-polarized antenna, can be achieved. For example, the third connection node array 131 and the first connection node array 112 can be used to perform a first connection at the first angle or the second angle, the fourth connection node array 132 and the second connection node array 132 can be used to perform a second connection at the first angle or the second angle; the combination of the first and second connections can form the phase antenna assembly 10 in different polarization manners, such as a polarization manner for two groups of horizontally polarized antennas, a polarization manner for two groups of vertically polarized antennas, or a polarization manner for a dual-polarized antenna.

Optionally, an extending direction of the first common trace 116 is parallel to an extending direction of the second common trace 126, or the extending direction of the first common trace 116 is perpendicular to the extending direction of the second common trace 126.

In this embodiment, when the extending direction of the first common trace 116 is parallel to the extending direction of the second common trace 126, the first antenna baseboard 11 and the second antenna baseboard 12 are in a mutually parallel state, that is, polarization directions of the first antenna baseboard 11 and of the second antenna baseboard 12 are identical, such as two groups of horizontally polarized antennas or two groups of vertically polarized antennas. When the extending direction of the first common trace 116 is perpendicular to the extending direction of the second common trace 126, the first antenna baseboard 11 and the second antenna baseboard 12 are in a mutually perpendicular state, that is, polarization directions of the first antenna baseboard 11 and of the second antenna baseboard 12 are different, such as a dual-polarized antenna.

Optionally, the third connection node array 131 and the first connection node array 112 perform connection at the first angle, and the fourth connection node array 132 and the second connection node array 122 perform connection at the first angle, so as to achieve the phase antenna assembly 10 in a first polarization manner.

Specifically, the phase antenna assembly 10 in the first polarization manner can be two groups of vertically polarized antennas.

Figure 4:
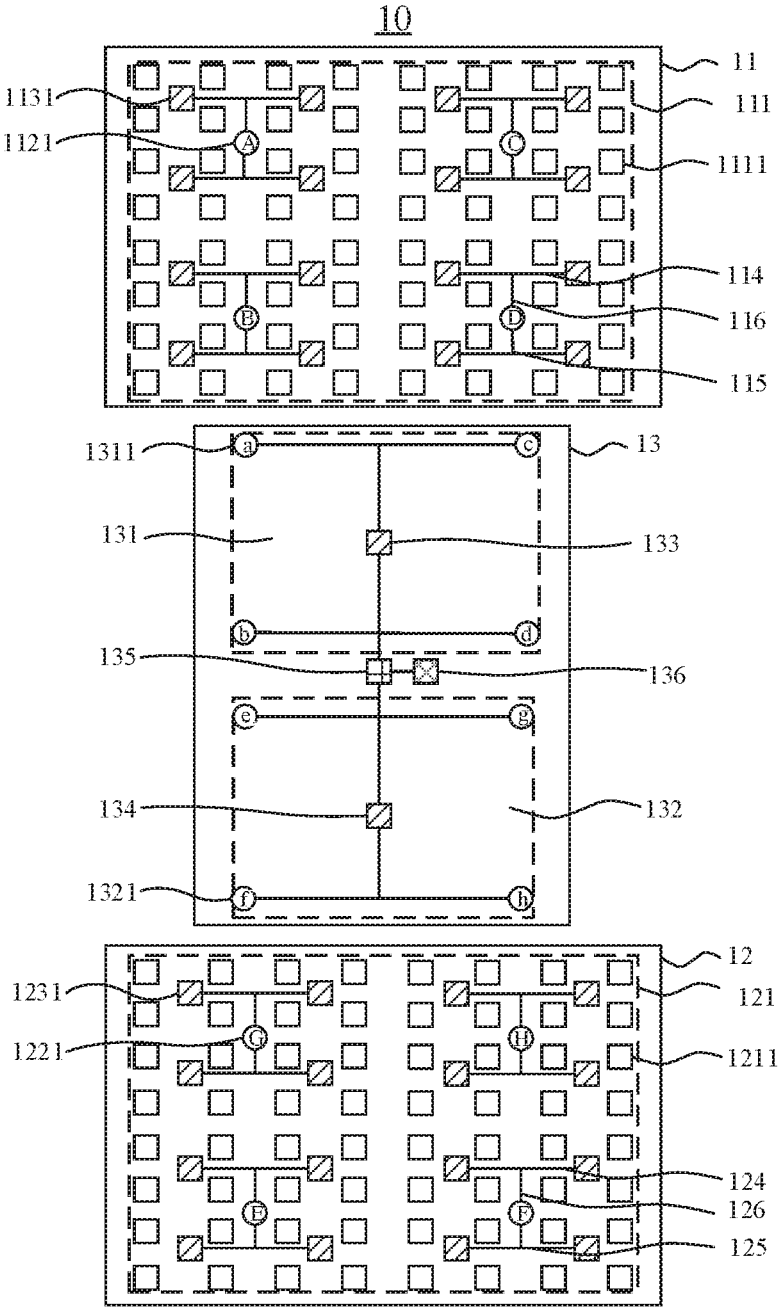
FIG. 4 is a structural schematic view of a first connecting state of an embodiment of a phase antenna assembly of the present disclosure.

Referring to FIG. 4, FIG. 4 is a structural schematic view of a first connecting state of an embodiment of a phase antenna assembly of the present disclosure.

The first antenna baseboard 11 and the second antenna baseboard 12 develops the vertical polarization direction simultaneously. The first connection node array 112 and the third connection node array 131 perform connection at the first angle, that is, are connected in a manner of A to a, B to b, C to c, D to d. The second connection node array 122 and the fourth connection node array 132 perform connection at the first angle, that is, are connected in a manner of E to f, F to h, G to e, H to g. Thus, signal conversion or transmission is performed through the transceiver 135 on the connection baseboard 13, two groups of vertically polarized antennas can be achieved.

Optionally, the third connection node array 131 and the first connection node array 112 perform connection at the first angle, and the fourth connection node array 132 and the second connection node array 122 perform connection at the second angle, so as to achieve the phase antenna assembly 10 in a second polarization manner.

Specifically, the phase antenna assembly 10 in the second polarization manner can be a dual-polarized antenna.

Figure 5:
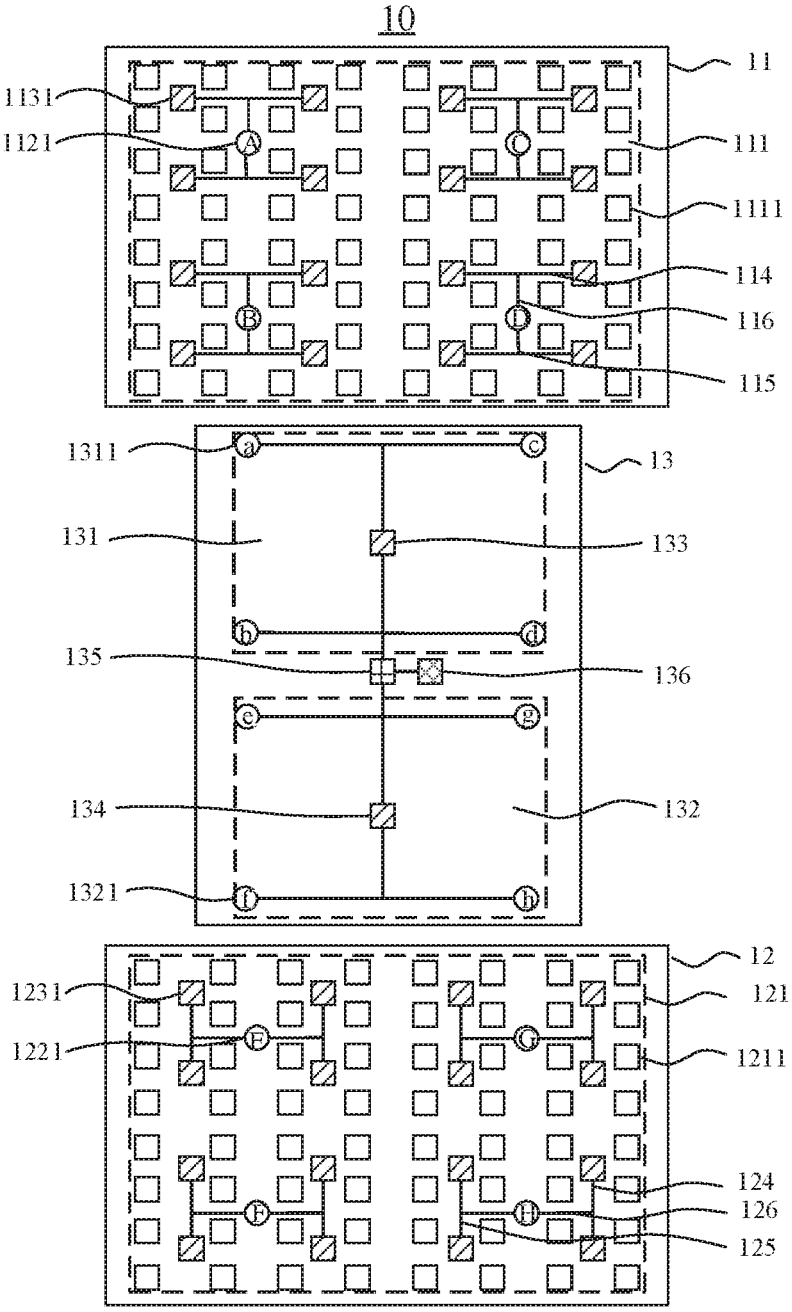
FIG. 5 is a structural schematic view of a second connecting state of an embodiment of a phase antenna assembly of the present disclosure.

Referring to FIG. 5, FIG. 5 is a structural schematic view of a second connecting state of an embodiment of a phase antenna assembly of the present disclosure.

The first antenna baseboard 11 and the second antenna baseboard 12 develops the vertical polarization direction simultaneously. The first connection node array 112 and the third connection node array 131 perform connection at the first angle, that is, are connected in a manner of A to a, B to b, C to c, D to d. The fourth connection node array 132 and the second connection node array 122 perform connection at the second angle, that is, after the second antenna baseboard 12 is rotated by 90 degrees or 270 degrees, the polarization direction of the second antenna baseboard 12 is changed into horizontal, and the second connection node array 122 and the fourth connection node array 132 are connected in a manner of E to e, F to f, G to g, H to h. Thus, signal conversion or transmission is performed through the transceiver 135 on the connection baseboard 13, a dual-polarized antenna can be achieved.

Optionally, the third connection node array 131 and the first connection node array 112 perform connection at the second angle, and the fourth connection node array 132 and the second connection node array 122 perform connection at the second angle, so as to achieve the phase antenna assembly 10 in a third polarization manner.

Specifically, the phase antenna assembly 10 in the third polarization manner can be two groups of horizontally polarized antennas.

Figure 6:
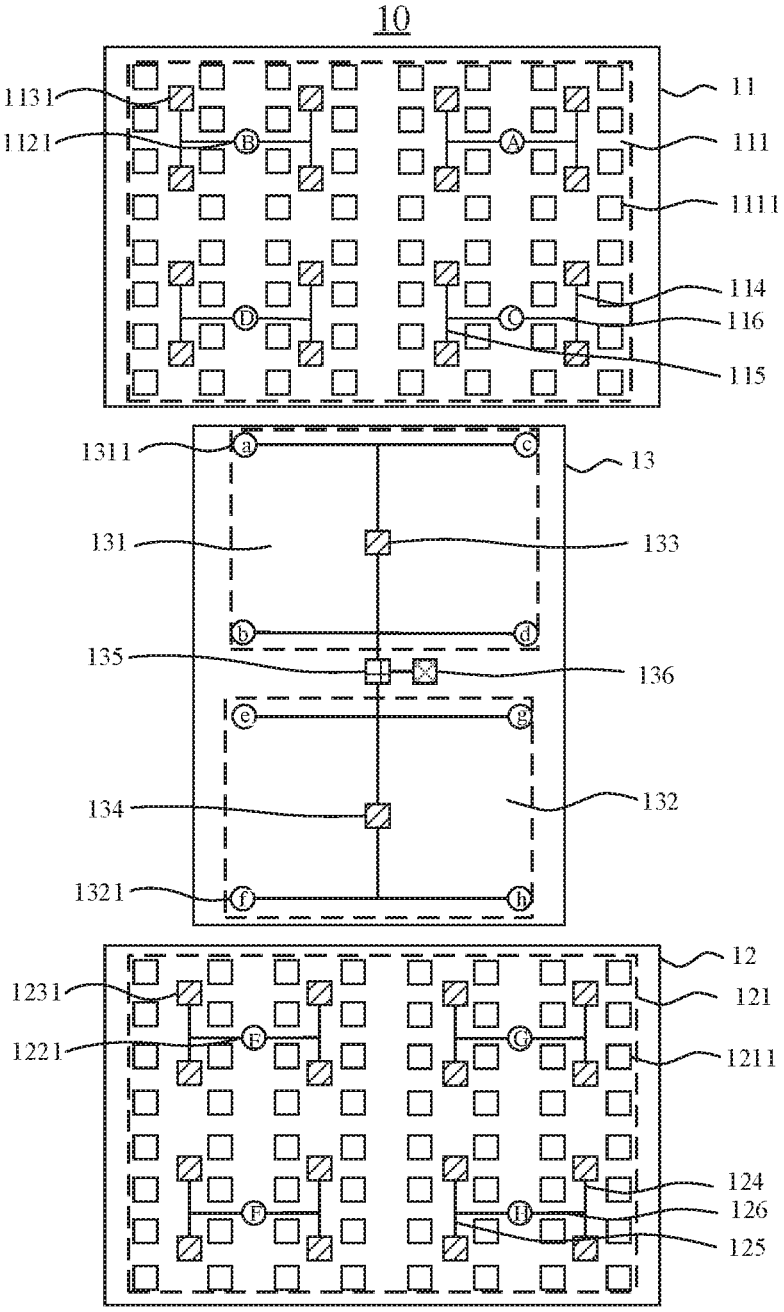
FIG. 6 is a structural schematic view of a third connecting state of an embodiment of a phase antenna assembly of the present disclosure.

Referring to FIG. 6, FIG. 6 is a structural schematic view of a third connecting state of an embodiment of a phase antenna assembly of the present disclosure.

The first antenna baseboard 11 and the second antenna baseboard 12 develops the vertical polarization direction simultaneously. The third connection node array 131 and the first connection node array 112 perform connection at the second angle, that is, after the first antenna baseboard 11 is rotated by 90 degrees or 270 degrees, and the polarization direction of the first antenna baseboard 11 is changed into horizontal, the first connection node array 112 and the third connection node array 131 are connected in a manner of A to c, B to a, C to d, D to b. The fourth connection node array 132 and the second connection node array 122 perform connection at the second angle, that is, after the second antenna baseboard 12 is rotated by 90 degrees or 270 degrees, and the polarization direction of the second antenna baseboard 12 is changed into horizontal, the second connection node array 122 and the fourth connection node array 132 are connected in a manner of E to e, F to f, G to g, H to h. Thus, signal conversion or transmission is performed through the transceiver 135 on the connection baseboard 13, two groups of horizontally polarized antennas can be achieved.

In conclusion, the present disclosure does not require determining or stabilizing polarization directions during designing or manufacturing, After manufacturing the first antenna baseboard 11, the second antenna baseboard 12, and the connection baseboard 13, since at least two kinds of connections by different angles can be implemented between the third connection node array 131 and the first connection node array 112, and/or at least two kinds of connections by different angles can be implemented between the fourth connection node 132 array and the second connection node array 122, by adjusting respective connecting angles of the first antenna baseboard 11, the second antenna baseboard 12, and the connection baseboard 13, the polarization direction of the whole antenna assembly can be adjusted or changed, and it is possible to realize effect that a dual-polarized antenna or a multi-polarized antenna is achieved by means of assembling two or more mono-polarized antennas by different angles.

The present disclosure, by means of assembly, can further realize various combined polarization manners of antennas, for example, two groups of vertically polarized antennas, two groups of horizontally polarized antennas, or a dual-polarized antenna. Moreover, the present disclosure can solve the conventional technical problem that when transceivers and multi-channel phase arrays are integrated in the same baseboard, a multi-channel power divider is required, which will increase design difficulty and heighten additional interstage loss. Thus, the technical effect of lowering complexity of the power divider and minimizing interstage loss as much as possible is achieved.

Figure 7:
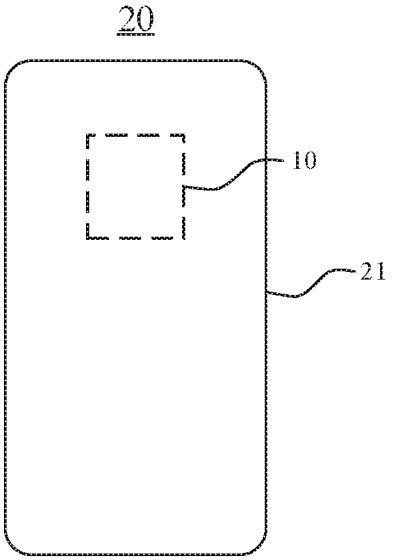
FIG. 7 is a structural schematic view of an embodiment of an electronic device of the present disclosure.

Furthermore, the present disclosure further provides an electronic device 20. Referring to FIG. 7, FIG. 7 is a structural schematic view of an embodiment of an electronic device 20 of the present disclosure.

As shown in FIG. 7, the electronic device 20 comprises the aforesaid phase antenna assembly 10 and a device body 21, the phase antenna assembly 20 is disposed on the device body 21.

The aforesaid electronic device can be devices such as smart phones, tablet computers, etc., and can also be game devices, AR (Augmented Reality) devices, vehicular devices, data storage devices, audio playing devices, video playing devices, notebook computers, desktop computing devices, etc. The device body is the part of the electronic device for implementing its main functions, and helps the phase antenna assembly 10 to further realize signal reception or radiation function.

Moreover, the type of the antenna in the present disclosure can be a patch antenna, a loop antenna, a mono-pole antenna, or a slot antenna.

The above are merely embodiments of the present disclosure and are not intended to limit the patent scope of the present disclosure. Any equivalent structure or equivalent process transformation made with content of the specification and drawings of the present disclosure, or direct or indirect use in other relating technical fields, are all similarly included in the patent protection scope of the present disclosure.

What is claimed is:

1. A phase antenna assembly, comprising:

a first antenna baseboard, wherein the first antenna baseboard includes a first polarization antenna array and a first connection node array;

a second antenna baseboard, wherein the second antenna baseboard includes a second polarization antenna array and a second connection node array; and a connection baseboard, wherein the connection baseboard includes a third connection node array and a fourth connection node array;

wherein, the third connection node array is electrically connectable with the first connection node array by at least two connection manners with different angles, and/or the fourth connection node array is electrically connectable with the second connection node array by at least two connection manners with different angles.

2. The phase antenna assembly according to claim 1, wherein, the third connection node array and the first connection node array are rotationally symmetric, and/or the fourth connection node array and the second connection node array are rotationally symmetric.

3. The phase antenna assembly according to claim 2, wherein, the third connection node array and the first connection node array are rotationally symmetric by 90 degrees, and/or the fourth connection node array and the second connection node array are rotationally symmetric by 90 degrees.

4. The phase antenna assembly according to claim 3, wherein, the third connection node array and the first connection node array are configured to perform a first connection at a first angle or a second angle, the fourth connection node array and the second connection node array are configured to perform a second connection at a first angle or a second angle, and the first and second connections are configured to be combined to form the phase antenna assembly in different polarization manners.

5. The phase antenna assembly according to claim 4, wherein, the third connection node array and the first connection node array perform the first connection at the first angle, and the fourth connection node array and the second connection node array perform the second connection at the first angle, so as to make the phase antenna assembly in a first polarization manner.

6. The phase antenna assembly according to claim 4, wherein, the third connection node array and the first connection node array perform the first connection at the first angle, and the fourth connection node array and the second connection node array perform the second connection at the second angle, so as to make the phase antenna assembly in a second polarization manner.

7. The phase antenna assembly according to claim 4, wherein, the third connection node array and the first connection node array perform the first connection at the second angle, and the fourth connection node array and the second connection node array perform the second connection at the second angle, so as to make the phase antenna assembly in a third polarization manner.

8. The phase antenna assembly according to claim 4, wherein, a plane where the third connection node array is located is parallel to a plane where the first connection node array is located; an arranging direction of node arrays in the plane where the third connection node array is located is defined as 0 degree, the first angle is 0 degree, 180 degrees, or 360 degrees, and the second angle is 90 degrees or 270 degrees;

a plane where the fourth connection node array is located is parallel to a plane where the second connection node array is located; an arranging direction of node arrays in the plane where the fourth connection node array is located is defined as 0 degree, the first angle is 0 degree, 180 degrees, or 360 degrees, and the second angle is 90 degrees or 270 degrees.

9. The phase antenna assembly according to claim 1, wherein, the first antenna baseboard includes a plurality of first chip groups arranged in a matrix, some first chips of the first chip group are electrically connected together via a first trace, the other first chips of the first chip group are electrically connected via a second trace, respectively middle points of the second trace and of the first trace are electrically connected together via a first common trace, a middle of the first common trace is provided with a first connection node, and the first connection nodes corresponding to the plurality of first chip groups are arranged in an array to form the first connection node array;

the second antenna baseboard includes a plurality of second chip groups arranged in a matrix, some second chips of the second chip group are electrically together connected via a third trace, the other second chips of the second chip group are electrically connected together via a fourth trace, respectively middle points of the third traced of the fourth trace are electrically connected via a second common trace, a middle of the second common trace is provided with a second connection node, and the second connection nodes corresponding to the plurality of second chip groups are arranged in an array to form the second connection node array;

the third connection node array includes a plurality of third connection nodes arranged in an array, the number of the third connection nodes is equal to the number of the first connection nodes, and the third connection nodes are in one-to-one correspondence with the first connection nodes;

the fourth connection node array includes a plurality of fourth connection nodes arranged in an array, the number of the fourth connection nodes is equal to the number of the second connection nodes, and the fourth connection nodes are in one-to-one correspondence with the second connection nodes.

10. The phase antenna assembly according to claim 9, wherein, the connection baseboard further comprises a transceiver and a phase locked loop, the third connection nodes, the fourth connection nodes, and the phase locked loop are respectively electrically connected with the transceiver;

an extending direction of the first common trace is parallel to an extending direction of the second common trace, or the extending direction of the first common trace is perpendicular to the extending direction of the second common trace.

11. The phase antenna assembly according to claim 1, wherein, the connection baseboard further includes a third chip and a fourth chip, the third chip is electrically connected with the third connection nodes, the fourth chip is electrically connected with the fourth connection nodes, both the third chip and the fourth chip are provided thereon with power dividers, so as to realize distribution and synthesis for signal energy.

12. The phase antenna assembly according to claim 1, wherein, the third connection node array is connected with the first connection node array through metal fasteners or wires, and/or the fourth connection node array is connected with the second connection node array through metal fasteners or wires.

13. An electronic device, comprising a phase antenna assembly according to claim 1 and a device body, wherein the phase antenna assembly is disposed on the device body.

* * * * *